US008516619B2

(12) United States Patent
Absi et al.

(10) Patent No.: US 8,516,619 B2
(45) Date of Patent: Aug. 27, 2013

(54) READY TO WEAR HEADSCARF

(76) Inventors: Mohammad Mubde Absi, Beirut (LB); Hala Absi, Beirut (LB); Mona Absi, Beirut (LB); Nadra Absi, Beirut (LB)

( * ) Notice: Subject to any disclaimer, the term of this patent is extended or adjusted under 35 U.S.C. 154(b) by 0 days.

(21) Appl. No.: 13/393,543

(22) PCT Filed: Nov. 4, 2009

(86) PCT No.: PCT/IB2009/054887

§ 371 (c)(1),
(2), (4) Date: Apr. 3, 2012

(87) PCT Pub. No.: WO2011/055166

PCT Pub. Date: May 12, 2011

(65) Prior Publication Data

US 2012/0291181 A1 Nov. 22, 2012

(51) Int. Cl.
*A42B 5/00* (2006.01)
*A42B 1/04* (2006.01)

(52) U.S. Cl.
USPC ..... 2/207; 2/202

(58) Field of Classification Search
USPC ..... 2/174, 202, 203, 204, 205, 207, 244, 2/279, 918
See application file for complete search history.

(56) References Cited

U.S. PATENT DOCUMENTS 1,056,391 A * 3/1913 Baldwin ..... 2/204
1,061,991 A * 5/1913 Drullard ..... 2/204
1,819,558 A * 8/1931 Husman ..... 2/174
1,897,100 A * 2/1933 Abbott ..... 2/174
D120,721 S * 5/1940 Posin ..... D2/878
D130,741 S * 12/1941 Brenner ..... D2/880
D138,607 S * 8/1944 Schoer ..... D2/879
2,363,198 A * 11/1944 Paull ..... 2/171.04
2,372,040 A * 3/1945 Wolfe ..... 2/203
2,435,688 A * 2/1948 Lupo ..... 2/207
2,665,427 A * 1/1954 Street et al. ..... 2/195.7
D171,903 S * 4/1954 Litwin ..... D2/880
2,678,449 A * 5/1954 Turscak et al. ..... 2/203
2,686,317 A * 8/1954 Michaelis ..... 2/205
2,806,222 A * 9/1957 Carpenter ..... 2/91
2,839,757 A * 6/1958 Gianola ..... 2/205
2,880,424 A * 4/1959 Kalensky ..... 2/202
2,970,318 A * 2/1961 Nordling ..... 2/202
3,060,449 A * 10/1962 Lehnhard ..... 2/203
3,201,803 A * 8/1965 Gettinger ..... 2/207
3,231,900 A * 2/1966 Gettinger ..... 2/207
3,238,536 A * 3/1966 Gettinger ..... 2/207
3,327,321 A * 6/1967 Hamer ..... 132/274
3,357,027 A * 12/1967 Feil ..... 2/209.11
3,377,628 A * 4/1968 Le Sante ..... 2/207
3,466,665 A * 9/1969 Mooney ..... 2/207
3,480,970 A * 12/1969 Gettinger ..... 2/207
3,541,610 A * 11/1970 Gettinger ..... 2/203
3,636,962 A * 1/1972 Frackowiak ..... 132/60
D232,498 S * 8/1974 Cianciolo ..... D2/502
3,935,597 A * 2/1976 Frechmann et al. ..... 2/207
4,110,846 A * 9/1978 Hernandez ..... 2/203
4,462,117 A * 7/1984 Brunelle ..... 2/202
4,492,242 A * 1/1985 Dalton ..... 132/53
4,788,722 A * 12/1988 Oliver ..... 2/207

(Continued)

*Primary Examiner* — Alissa L Hoey

(57) ABSTRACT

A headscarf for women and in particular veiled women is provided which includes a garment element sewn to a predetermined formed style to covers a wearer's head and neck. The headscarf maintains the formed style of a scarf worn particularly by veiled women. Additionally, the headscarf can be provided with styling accessories.

5 Claims, 14 Drawing Sheets

(56) References Cited

U.S. PATENT DOCUMENTS

| | | | | | |
|---|---|---|---|---|---|
| D309,671 | S | * | 8/1990 | Kassel | D2/878 |
| 5,083,318 | A | * | 1/1992 | Hook | 2/207 |
| 5,161,260 | A | * | 11/1992 | Reynolds | 2/207 |
| 5,287,560 | A | * | 2/1994 | Garcia | 2/202 |
| 5,293,646 | A | * | 3/1994 | Winston | 2/88 |
| 5,694,647 | A | * | 12/1997 | Crickmore | 2/172 |
| 5,790,986 | A | * | 8/1998 | Hall | 2/172 |
| 5,806,535 | A | * | 9/1998 | Becker | 132/54 |
| 5,832,538 | A | * | 11/1998 | Williams | 2/202 |
| 6,006,360 | A | * | 12/1999 | Reed | 2/202 |
| 6,145,131 | A | * | 11/2000 | Huff | 2/207 |
| 6,425,138 | B1 | * | 7/2002 | Johnson | 2/202 |
| 6,735,783 | B2 | * | 5/2004 | Phillips | 2/202 |
| 6,789,266 | B1 | * | 9/2004 | Mills et al. | 2/172 |
| 7,231,670 | B2 | * | 6/2007 | Chang | 2/207 |
| 7,467,422 | B2 | * | 12/2008 | Bugarin | 2/202 |
| 7,634,819 | B2 | * | 12/2009 | Grey | 2/207 |
| D607,628 | S | * | 1/2010 | Dawson et al. | D2/878 |
| 7,681,251 | B2 | * | 3/2010 | Carey | 2/171 |
| 7,836,522 | B2 | * | 11/2010 | Blecha | 2/207 |
| 7,836,523 | B2 | * | 11/2010 | Castle | 2/207 |
| 8,225,429 | B2 | * | 7/2012 | Tawfik | 2/207 |
| D668,842 | S | * | 10/2012 | Lumpkin | D2/866 |
| D672,534 | S | * | 12/2012 | Smith | D2/878 |
| 2003/0221243 | A1 | * | 12/2003 | Phillips | 2/202 |
| 2005/0015850 | A1 | * | 1/2005 | Waldman | 2/205 |
| 2006/0130213 | A1 | * | 6/2006 | Mickle | 2/202 |
| 2006/0253959 | A1 | * | 11/2006 | Chang | 2/207 |
| 2006/0278252 | A1 | * | 12/2006 | Miller | 132/274 |
| 2007/0266476 | A1 | * | 11/2007 | Ulrich | 2/202 |
| 2008/0209614 | A1 | | 9/2008 | Beausang | |
| 2008/0235851 | A1 | * | 10/2008 | Grey | 2/174 |
| 2008/0295221 | A1 | | 12/2008 | Grey | |
| 2009/0000011 | A1 | * | 1/2009 | Halley | 2/207 |
| 2009/0106878 | A1 | * | 4/2009 | Hiskey | 2/207 |
| 2009/0126077 | A1 | * | 5/2009 | O'Neal | 2/202 |
| 2009/0126078 | A1 | * | 5/2009 | Rashid | 2/207 |
| 2009/0151055 | A1 | * | 6/2009 | Duncan | 2/410 |
| 2009/0178176 | A1 | * | 7/2009 | Rowe et al. | 2/172 |
| 2009/0222969 | A1 | * | 9/2009 | Townsend | 2/88 |
| 2010/0037367 | A1 | * | 2/2010 | Benderradji | 2/202 |
| 2010/0058515 | A1 | * | 3/2010 | Castle | 2/207 |
| 2010/0275946 | A1 | * | 11/2010 | Ruschell | 132/210 |
| 2011/0055999 | A1 | * | 3/2011 | Su | 2/207 |
| 2011/0131704 | A1 | * | 6/2011 | Hughes | 2/204 |
| 2011/0209266 | A1 | * | 9/2011 | Perry | 2/207 |
| 2012/0204323 | A1 | * | 8/2012 | Park | 2/202 |
| 2012/0324624 | A1 | * | 12/2012 | Day | 2/202 |

* cited by examiner

READY TO WEAR HEADSCARF

FIELD OF THE INVENTION

This application relates to clothing and more particularly pertains to a headscarf for women and in particular veiled women, that is ready-to-wear and covers a wearer's head or a wearer's head and neck and maintains a wrapped formed style of an ordinary scarf worn by veiled women. Plurality of styling accessories are associated with the ready-to-wear headscarf.

BACKGROUND OF THE INVENTION

It has long been recognized that a woman headscarf can be made from a scarf wrapped around the head and neck. Such headscarves have mostly been associated with veiled women. These headscarves are worn by millions of young and old women around the world, and are supplied in vast number of sizes, shapes, fabrics, styles and finishes.

While ordinary scarves and special purpose scarves of prior art fulfill their objectives and requirements, they have many common problems. These problems were observed by veiled women themselves, and here are some:

1. It takes time to wrap and fix a scarf in a proper and consistent shape every time it is worn which is a cause of concern to most women especially working women. It can take up to 20 minutes to properly wrap an ordinary headscarf.

2. Wearing a headscarf in a stylish and trendy manner is not easy and it can only be done by some women and professional hair dressers.

3. The amount of fabric that is wrapped around the neck in some headscarf styles is a cause of discomfort especially in warm weather.

4. Many young girls who lack experience in wrapping their headscarves are hindered by wearing these headscarves to the extent of giving up many of their outdoor activities.

5. Many ladies give up the stylish look of a properly wrapped headscarf to a less stylish look because they have difficulty wearing the wrapped headscarf.

6. Many special purpose scarves do not meet the fundamental requirement of head and neck coverage required by the veiled women religious belief.

7. It is hard to wrap a scarf around the head and keep in place without pins or safety pins. These pins or safety pins can be unsafe and might cause minor injuries to the wearer and are a source of potential fabric damage.

In this respect, the ready-to-wear headscarf according to the present invention substantially departs from the conventional concepts and designs of the prior art, and in doing so provides an apparatus primarily developed to be ready-to-wear and for the purpose of covering a wearer's head or head and neck and maintaining the form and look of a veiled woman headscarf in a plurality of styles.

Therefore, it can be appreciated that there exists a compelling need for a new headscarf which is ready-to-wear and covering a wearer's head or head and neck and maintaining the form and look of a veiled woman headscarf in a plurality of styles. In this regard, the present invention substantially fulfills this need.

DISCLOSURE OF INVENTION

The invention headscarf solves all of the above problems found in ordinary scarves and that's how it does that:

1. The invention headscarf is ready-to-wear and can be worn in less than a minute.

2. The invention headscarf does not require any experience to wear and thus can be worn by any female age group.

3. The invention headscarf fabric can be cut to any shape to eliminate the extra fabric material found in standard rectangular, triangular or square shaped scarves.

4. The invention headscarf has a consistent shape and comes in plurality of formed styles that is available to all women and does not require the specialized skills of a hair dresser.

5. The invention headscarf can not cause any injury to its wearer or the headscarf fabric because it does not use any pins or safety pins.

6. The ready-to-wear headscarf covers most of the female head or head and neck, thus satisfying the belief of many religious women.

7. The invention headscarf will provide formed styles and shapes that are known to some women communities but not known to others allowing exchange of cultural clothing styles.

The new ready-to-wear headscarf combined with integral and non integral styling accessories is also new.

SUMMARY

In view of the foregoing disadvantages inherent in the known types of scarves now present in the prior art, the present invention provides an improved headscarf. As such, the general purpose of the present invention, which will be described subsequently in greater detail, is to provide a new headscarf which has all the advantages of the prior art plus new built-in advantages and none of the disadvantages. The present invention provides a headscarf that is ready-to-wear and is capable of covering a wearers head or head and neck and maintaining the form and look of a headscarf worn particularly by veiled women.

The present invention is ready-to-wear and when worn over the head of the wearer, has an immediate wrapped form and stylish appearance and thus eliminating the difficulties associated with manual wrapping and folding and maintaining style of ordinary scarves.

The present invention ready-to-wear headscarf is—in one embodiment—fabricated with special cuts of fabrics to eliminate any extra fabric layers that accumulate as a result of wrapping an ordinary scarf over the neck which leads to sweating and discomfort while wearing the scarf for a long time.

To attain this, the present invention essentially comprises a garment element made from a single panel or a plurality of panels. Each panel having a shape and size selected from a plurality of shapes and sizes and is made of material selected from a group of materials. Each panel can be selected from any of plurality of ordinary scarves or specially fabricated scarves.

The invention ready-to-wear headscarf can be fabricated in unlimited number of ways to create the formed styles similar to those formed styles made by ordinary scarves. Variations can be but not limited to, the number of materials that make up the scarf, the different styles and wraps that shapes the headscarf and the different styling accessories that can be associated with the headscarf.

Associated with the headscarf are a set of styling accessories including but not limited to headbands, shapers, connectors, ornamental and decorative accessories.

The invention ready-to-wear headscarf combined with a headband is provided to complement some headscarves. These headbands include a plurality of objects made from a plurality of materials and can be placed over the head close to the forehead to perform any of plurality of functions including sweat absorption, stabilizing of headscarf position over the wearer head, and providing trendy and stylish appearance to the overall headscarf style. Headbands can be integrated with the headscarf by using a fastener.

Shaper accessories are used to provide headscarf shape and form variations. A hair bun, for example is used to improve the puffy appearance of the headscarf at any side of the wearer head.

Connectors accessories provide extra flexibility in wearing, sizing or styling a headscarf. Connectors are selected from a plurality of fasteners, stretch materials or fabrics.

Ornamental and decorative accessories include a plurality of objects such as fabric flowers and butterflies made from a plurality of materials such as fabric or metal and can be placed over the surface of the headscarf at any of plurality of locations such as right or left side with respect to the head of a wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new ready-to-wear headscarf which has all of the advantages of the prior art headscarves of known designs and configurations plus new inherent advantages and none of the disadvantages.

It is another object of the present invention to provide a new ready-to-wear headscarf which may be easily and efficiently manufactured and marketed. It is further object of the present invention to provide a new ready-to-wear headscarf which is of durable and reliable constructions. An even further object of the present invention is to provide a new ready-to-wear headscarf which is susceptible of a low cost of manufacture with regard to both materials and labor, and which accordingly is then susceptible of low prices of sale to the consuming public, thereby making such ready-to-wear headscarf economically available to the buying public. Even still another object of the present invention is to provide a new ready-to-wear headscarf capable of covering a wearer's head or head and neck and maintaining form and look of a veiled woman headscarf in a plurality of styles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiments of the invention.

DRAWINGS

Description of Figures

FIG. 7C shows two types of buttons and a hook. FIG. 7D is a belt. FIG. 7E is a zipper. FIG. 7F is snap on and FIG. 7G is a hook and loop.

DETAILED DESCRIPTION OF THE PREFERRED EMBODIMENTS

Figure 1A:
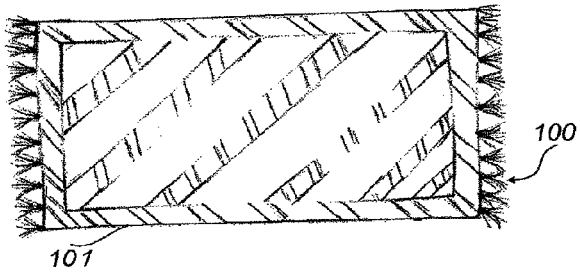
FIGS. 1A-1E shows a collection of scarves cut in different shapes and made from different fabrics.
Figure 1B:
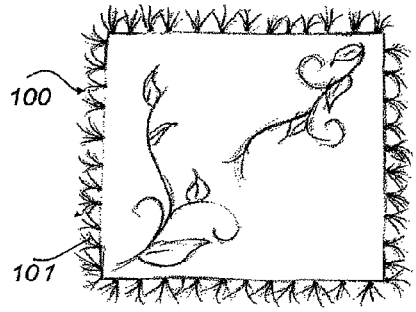
Figure 1C:
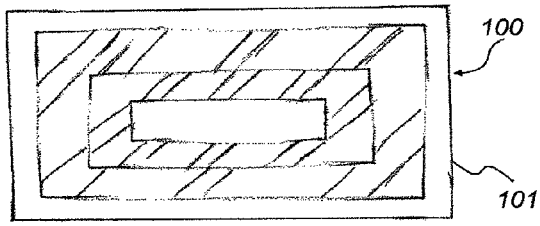
Figure 1D:
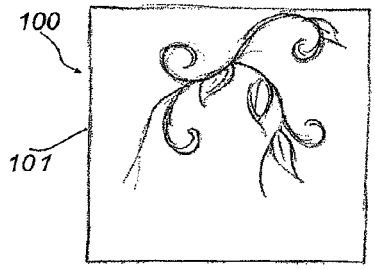
Figure 1E:
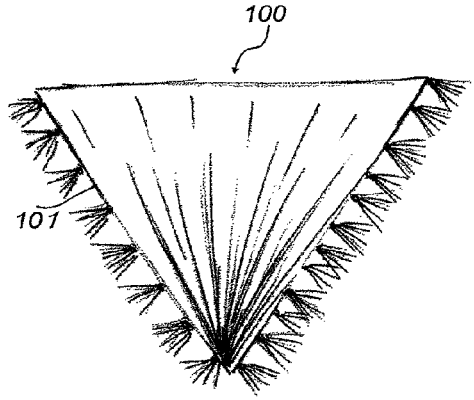

The present disclosure provides a ready-to-wear headscarf which is of a new construction and which, when worn, conveys a stylish shape and maintains a well wrapped appearance similar to that of a scarf manually wrapped around the head.

Before the present cloth accessory and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms 'a,' 'an,' and, 'the' include plural referents unless the context clearly dictates otherwise. Thus, for example, reference to 'the material' or 'a cloth' includes reference to one or more of such materials.

DEFINITIONS fabric As used herein, 'fabric' refers to synthetic or natural material made of one or more of wool, cotton, silk, satin, towel, polyester, fleece or any other natural or man-made material.

leather As used herein, 'leather' refers to synthetic or natural material made of one or more of animal skin, vinyl, chamois, or any other natural or man-made material.

shawl As used herein, 'shawl' refers to a simple item of clothing, loosely worn over the shoulders, upper body and arms, sometimes also over the head rectangular or square piece of cloth, that is often folded to make a triangle but can also be triangular in shape. Other shapes include oblong shawls.

scarf As used herein, 'scarf' refers to a piece of fabric worn on or near the head or around the neck for warmth, cleanliness, fashion or for religious reasons. Scarves are usually square, rectangular, triangular, or oblong and come in many sizes and fabrics. As used herein, 'scarf' will be used to refer to both of the above terms 'scarf' and 'shawl'.

hijab As used herein, 'hijab' refers to a scarf covering the head and neck and is traditionally worn by Muslim women.

headscarf As used herein, 'headscarf' refers to a scarf that covers a woman head or head and neck and is worn by wrapping a scarf in plurality of ways around the head or around the head and neck. As used herein, 'headscarf' will be used to refer to both of the above terms 'headscarf' and 'hijab'.

panel As used herein, 'panel' refers to a piece of any flexible material such as fabric or leather fabricated into a shape selected from the group consisting of circular, oval, rectangular, square, triangular, rhomboid, trapezoidal, cross, asterisk and oblong or any other regular or irregular shape.

garment As used herein, 'garment' refers to a piece of clothing made of one or plurality of panels that can be used for a purpose such as covering a woman head.

fastener As used herein, 'fastener' refers to a structure or method which is capable of at least partially closing, and holding closed, the opening between two elements. Examples of specific fasteners include without limitation, sewn stitches, snaps, hooks, straps, cords, hook and loop fasteners (i.e. Velcro®), buttons, drawstrings, buckles, clasps, magnets, flaps, belts, and zippers, among others.

stretch material As used herein, 'stretch material' is synthetic or natural material such as spandex, cotton and rayon lycra, stretchable nylon, stretchable vinyl, stretchable lace, fleece, stretchable denim, stretchable silk, and stretchable chamois, among others.

veiled woman As used herein, 'veiled woman' will be used to refer to a woman wearing a headscarf.

formed style As used herein, 'formed style' will be used to refer to a form and style of a headscarf covering a veiled woman head or head and neck in one of plurality of forms and styles similar to the forms and styles that are manually made by wrapping a scarf in one of plurality of forms and styles.

headband As used herein, 'headband' will be used to refer to any of a plurality of objects made from a plurality of materials and can be placed over the head close to the forehead to perform any of plurality of functions including sweat absorption, stabilizing of headscarf position over the wearer head, and providing trendy and stylish appearance to the overall headscarf style. Headbands can be integrated with the headscarf by using a fastener.

shaper As used herein, 'shaper' will be used to refer to any shaper accessories which can be used to provide headscarf shape and form variations. A hair bun, for example is used to improve the puffy appearance of the headscarf at any side of the wearer head.

ornamental As used herein, 'ornamental' will be used to refer to any ornamental and decorative accessories including a plurality of objects such as fabric flowers and butterflies made from a plurality of materials such as fabric or metal and can be placed over the surface of the headscarf at any of plurality of locations such as right or left side with respect to the head of a wearer.

connector As used herein, 'connector' will be used to refer to a connector accessory which provides functional properties to a headscarf such as flexible sizing, styling, fastening or other possible uses. A connector can be any one of plurality of fasteners, fabric, or stretch materials.

styling accessory As used herein, 'styling accessory' will be used to refer to headbands, shapers, connectors, and ornamental accessories or any other such accessories.

Hereinafter, embodiments of the invention will be explained with reference to the attached drawings.

Referring now to the drawings, in which like reference numerals identify identical or substantially similar parts throughout the several figures.

Starting from prior art scarves, FIGS. 1A-1E show a collection of scarves in plurality of shapes, sizes and fabrics. Showing and describing varieties of scarves is outside the scope of this disclosure.

These scarves are worn by women in many different ways. However, this disclosure emphasizes those ways of wearing scarves to cover the head or head and neck of the wearer only.

Figure 2A:
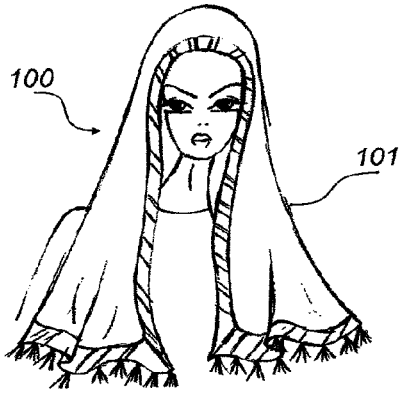
FIGS. 2A-2E show the steps to wrap a scarf to a formed style 200 according to one of the ways an ordinary headscarf or hijab is worn.

FIGS. 2A-2E illustrate only one of many ways of manually wrapping a scarf around the head or head and neck of a veiled woman. The following is a list of steps that describe these figures:

1. This scarf 100 is first put over head to cover it as shown in FIG. 2A.

Figure 2B:
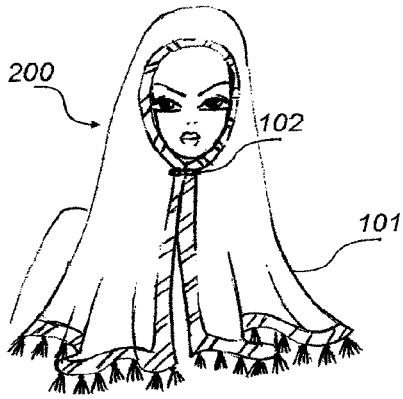

2. then, a safety pin 102 is usually used to tie the scarf sides around the face and over the neck so it does not fall loose as shown in FIG. 2B.

Figure 2C:
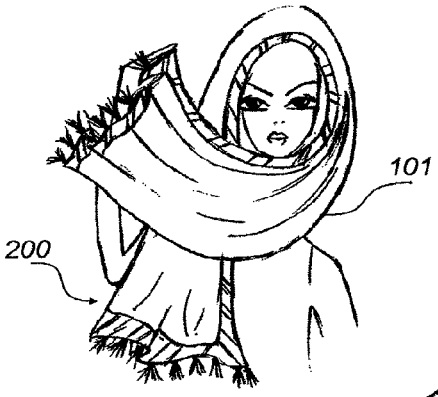
Figure 2D:
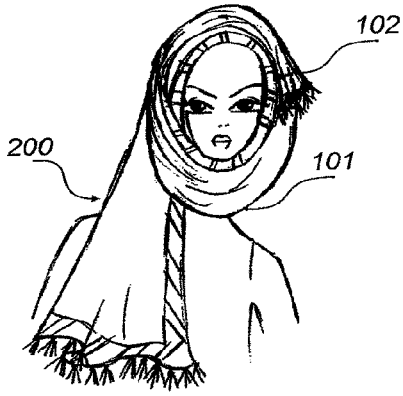

3. then, and is displayed In FIG. 2C, the left side of garment element 101 is wrapped around the neck and flipped over the right shoulder and over the head as in FIG. 2D.

4. then, another safety pin 102 is usually used to fix the edge of the scarf as shown in FIG. 2D.

Figure 2E:
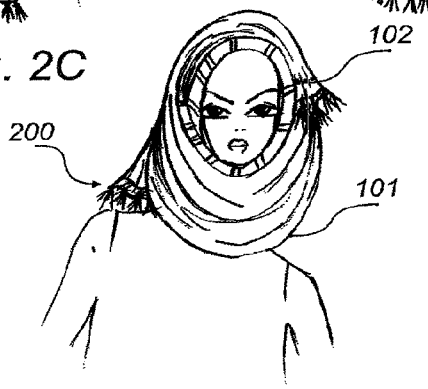
Figure 3A:
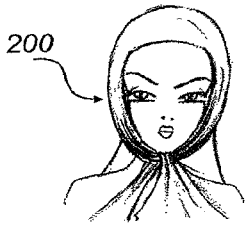
FIGS. 3A-3L shows a collection of ordinary headscarves worn in plurality of formed styles. The collection is shown as a sample and therefore should not be used to limit the scope of the invention.
Figure 3B:
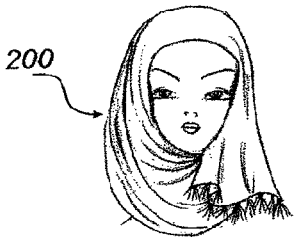
Figure 3C:
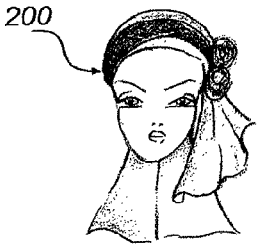
Figure 3D:
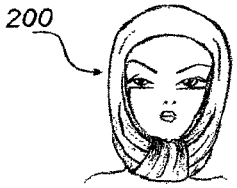
Figure 3E:
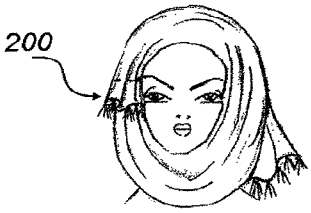
Figure 3F:
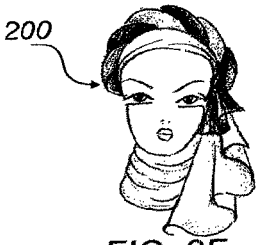
Figure 3G:
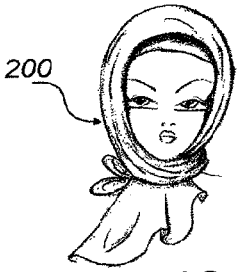
Figure 3H:
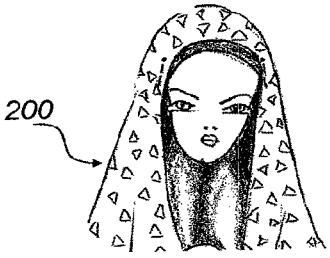
Figure 3I:
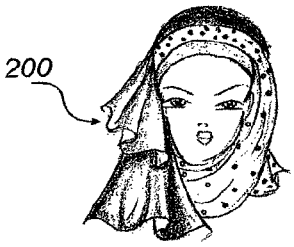
Figure 3J:
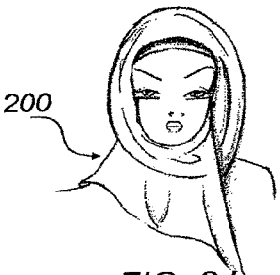
Figure 3K:
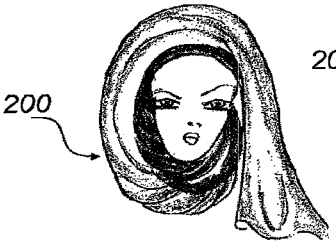
Figure 3L:
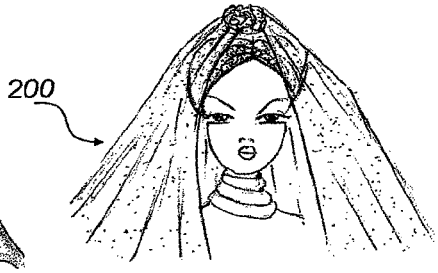

5. finally, the right side of garment element 101 is wrapped around the bottom of the head and fixed with a pin 102 as shown in FIG. 2E.

The end result is a headscarf wrapped around the head and neck of a wearer and in a formed style 200 as shown in FIG. 2E. This formed style 200 is one of the most commonly used headscarf wraps.

The above description of one way of manually wrapping a headscarf is presented as given information that helps in better describing the invention disclosed.

FIGS. 3A-3L illustrate some of many other formed styles of wrapping a scarf around the head or head and neck of a veiled woman. Some of these formed styles might actually involve much more effort and steps and repetition of steps to get to the end result.

Hereinafter, although embodiments of the invention will be explained with reference to examples, the present invention is not limited thereto.

BEST MODE

Figure 4A:
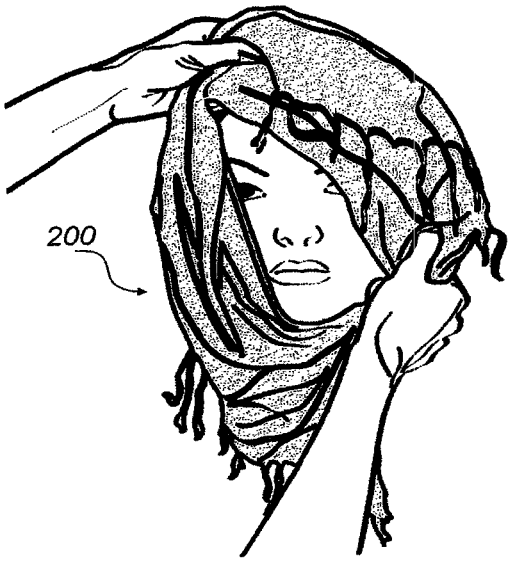
FIG. 4A shows a ready-to-wear headscarf in a formed style 200 being worn by a woman.
Figure 4B:
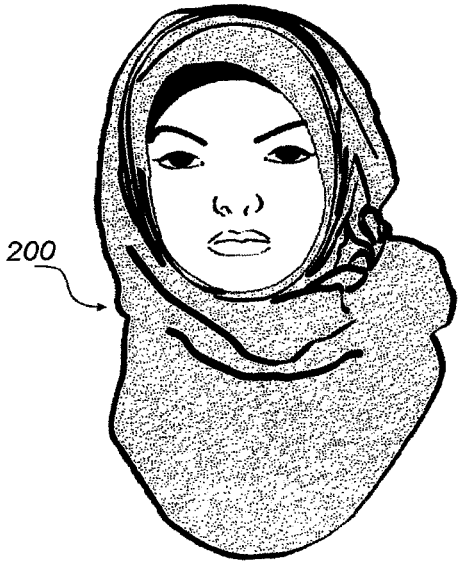
FIG. 4B is a perspective view of a woman wearing a ready-to-wear headscarf in a formed style 200.
Figure 4C:
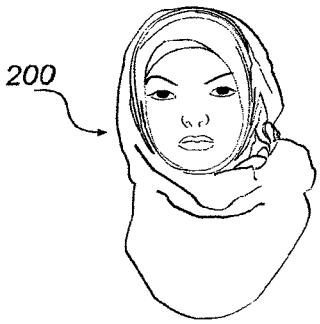
FIG. 4C is front plan view of a ready-to-wear headscarf in a formed style 200.
Figure 4D:
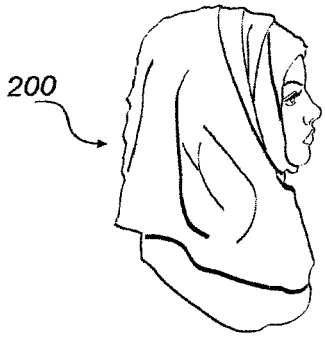
FIG. 4D is right plan view of a ready-to-wear headscarf in a formed style 200.
Figure 4E:
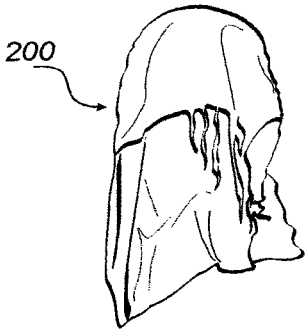
FIG. 4E is back plan view of a ready-to-wear headscarf in a formed style 200.
Figure 4F:
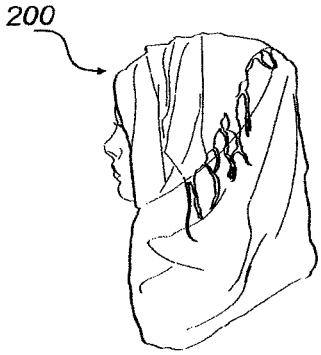
FIG. 4F is left plan view of a ready-to-wear headscarf in a formed style 200.
Figure 4G:
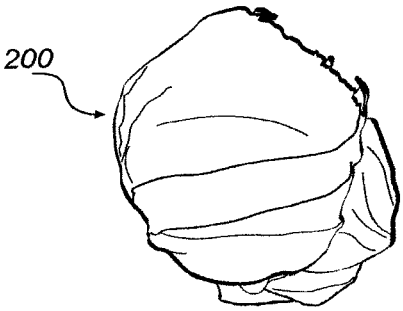
FIG. 4G is top plan view of a ready-to-wear headscarf in a formed style 200.
Figure 4H:
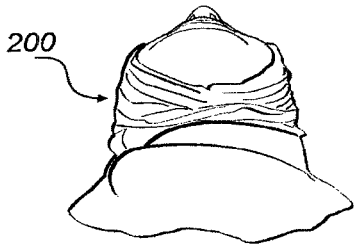
FIG. 4H is bottom plan view of a ready-to-wear headscarf in a formed style 200.

FIG. 4A illustrates, in perspective view, the first embodiment of ready-to-wear headscarf in accordance with the principles of the present disclosure. The ready-to-wear headscarf in a formed style 200 is simply put over the head and of the wearer and then pulled down to a final position as shown in FIG. 4B. Compare this procedure of wearing the invention headscarf with the steps required to manually wrap an ordinary scarf as described above.

Essentially, we are saying that the ready-to-wear headscarf 200 of FIG. 4B provides the wearer with the same formed style as achieved after completing the steps depicted in FIG. 2A through FIG. 2E to wear an ordinary scarf.

Figure 5A:
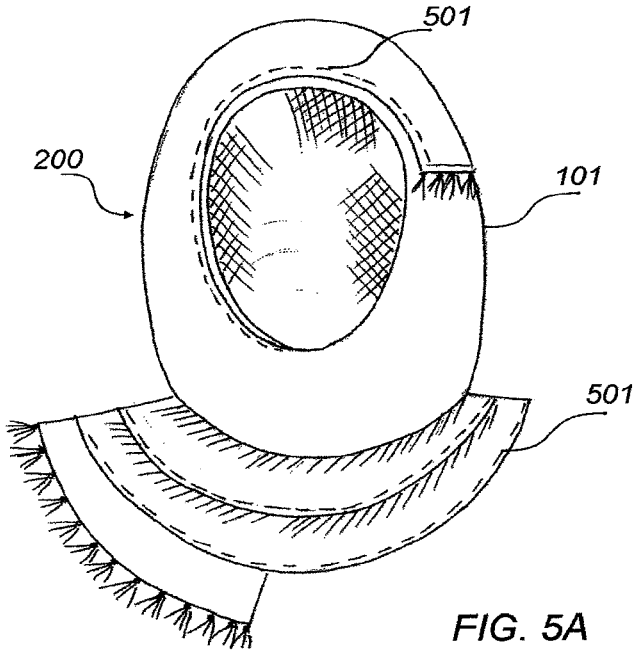
FIGS. 5A-5B shows the front and back plan views respectively of a ready-to-wear headscarf in a formed style 200 where a garment element 101 is stitched in several locations 501.
Figure 5B:
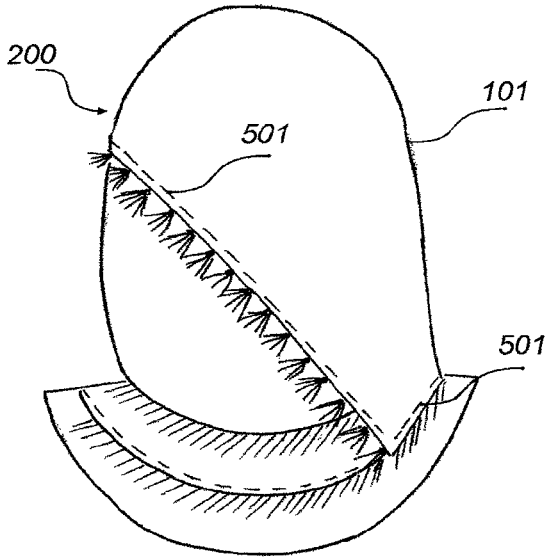
Figure 5C:
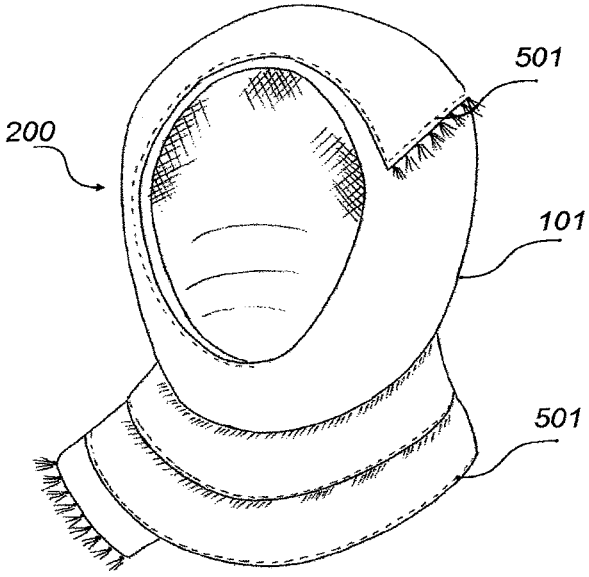
FIGS. 5C-5D shows the left and right perspective views of a ready-to-wear headscarf in a formed style 200 where a garment element 101 is stitched in several locations 501.
Figure 5D:
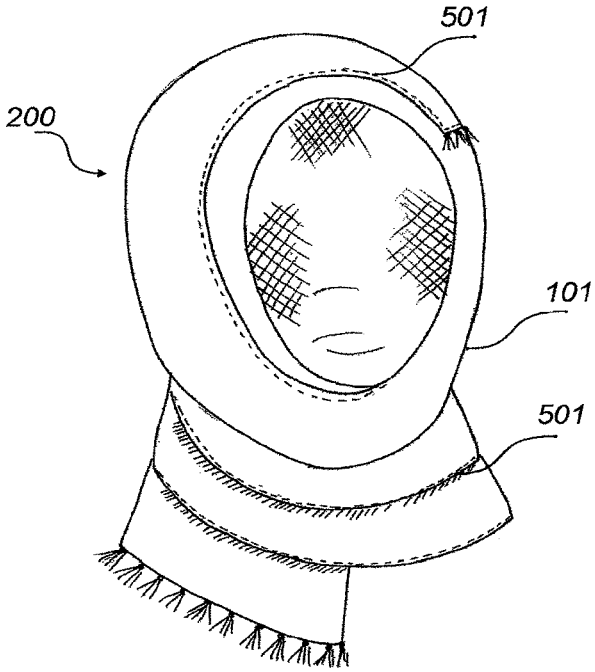

To make the ready-to-wear headscarf 200 of FIG. 4B, use an ordinary scarf selected from any of plurality of scarves; samples of which are shown in FIGS. 1A-1E as a garment element 101 of FIG. 5A, then incorporate a number of sewn stitches 501 as shown in FIG. 5B which depicts one way of sewing garment element 101 at a plurality of spaced locations. This is simply it. Some other formed styles might require extra stitches or different places for stitches, but the end result will be always the same, a ready-to-wear headscarf.

This same ready-to-wear headscarf, can incorporate a custom cut scarf to achieve better economy in making the final formed style of the headscarf. The headscarf, after cutting, is then stitched in different ways and in any appropriate locations to achieve that desired formed style which is normally achieved by ordinary headscarves. In addition to better economy, a ready-to-wear headscarf with custom cut scarf can be used to eliminate the discomfort caused by many layers of fabric wrapped around the neck.

Figure 6A:
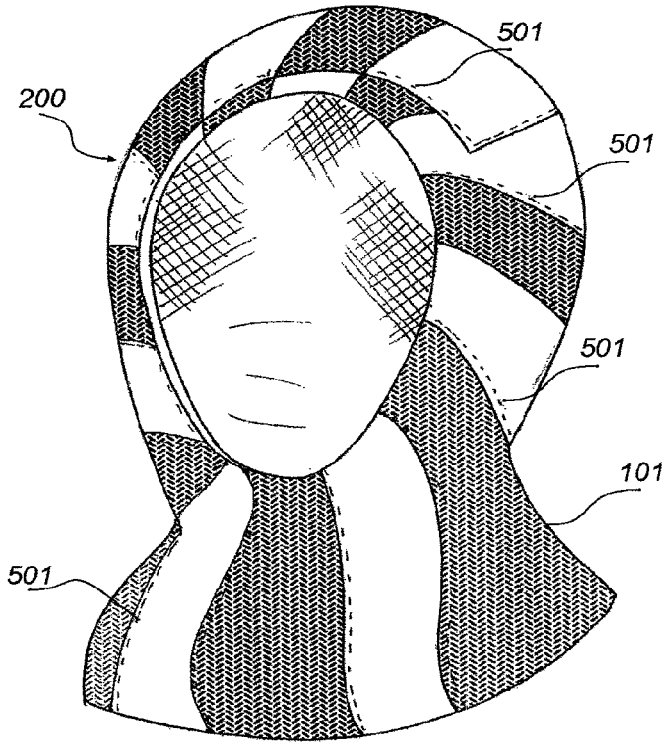
FIG. 6A is a ready-to-wear headscarf perspective where garment element 101 is fabricated from panel 600 (FIG. 6B) which incorporates two panels 601 and 602.
Figure 6B:
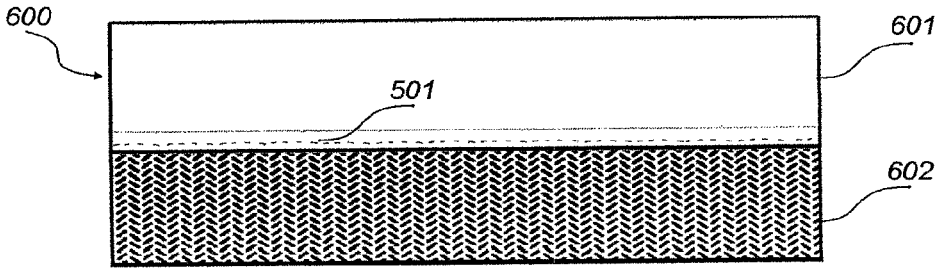

In addition to using a single scarf as garment element in fabricating the present invention, garment element 101 can be fabricated from a mix of panels. In FIG. 6B, two panels of different fabric and color are used; panel 601 and panel 602 are sewn to create scarf 600 which is then used as garment element 101 of the ready-to-wear headscarf 200 of FIG. 6A.

We have described above a sample method to produce the ready-to-wear headscarf 200 of FIG. 4A. But, this is just one method, and it should be obvious that there are many other ways and methods to fabricate the same headscarf. The same applies to many other formed styles of which a sample collection is presented in FIG. 3A through FIG. 3L. It is not the object of this description section to describe these methods.

While the above description contains many specificities, these should not be construed as limitations on the scope of any embodiment, but as exemplifications of the presently preferred embodiments thereof. Many other ramifications and variations are possible within the teachings of the various embodiments.

The invention, in its broader aspects, is therefore not limited to the specific details, representative system and methods, and illustrative examples shown and described above. Various modifications and variations can be made to the above specification without departing from the scope or spirit of the present invention, and it is intended that the present disclosure cover all such modifications and variations provided they come within the scope of the following claims and their equivalents.

Another Mode for Invention

Figure 7A:
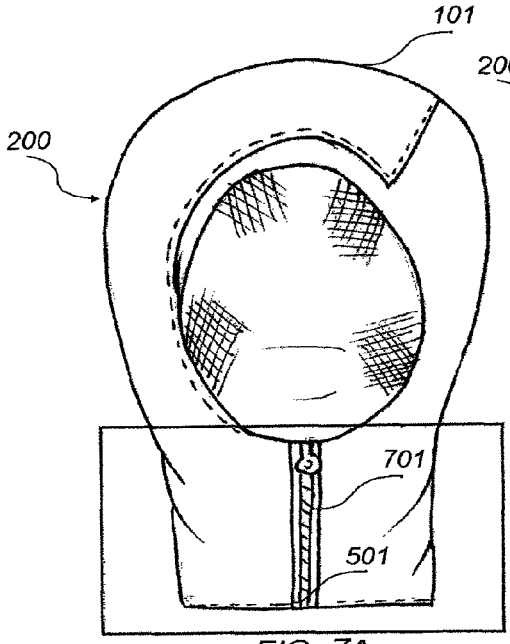
FIGS. 7A-7B shows the front and back plan views respectively of a ready-to-wear headscarf in a formed style 200 where a garment element 101 is stitched in several locations 501 and incorporates two portions.
Figure 7B:
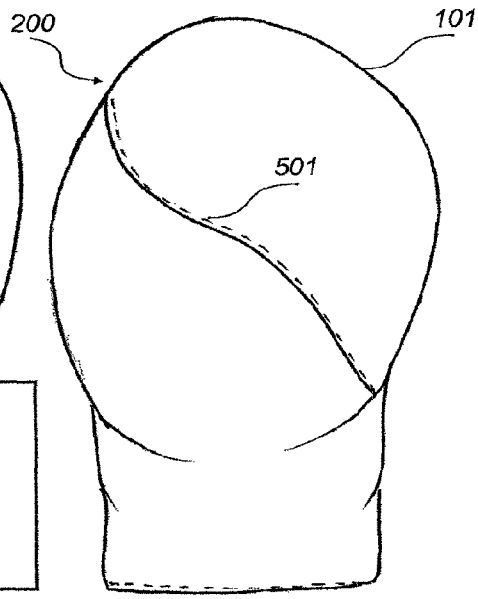
Figure 7C:
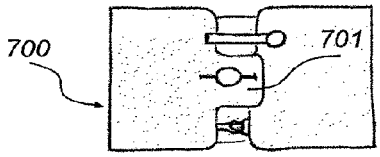
FIGS. 7C-7H displays some possible fasteners used in the flexible portion 701 of garment element 101.
Figure 7D:
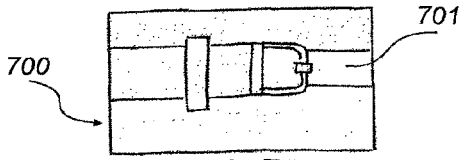
Figure 7E:
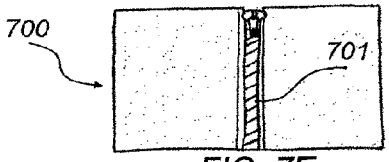
Figure 7F:
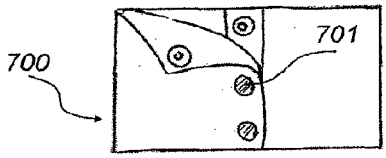
Figure 7G:
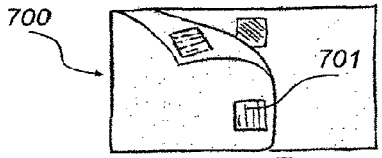

FIGS. 7A-7B illustrate, in front and back plan views, another exemplary embodiment of ready-to-wear headscarf in accordance with the principles of the present disclosure, where garment element 101 incorporates a connector that is placed on the garment element to join two sides and provide a fitting style at the neck of the wearer as one aspect of its use. In other aspects, this same connector can be used for resizing or styling or holding a headscarf edge in place.

In FIG. 7A, said garment element 101 incorporates a zipper fastener 701 as its connector. The connector styling accessory can be selected from a plurality of connectors as shown in FIG. 7C through FIG. 7G.

Figure 7H:
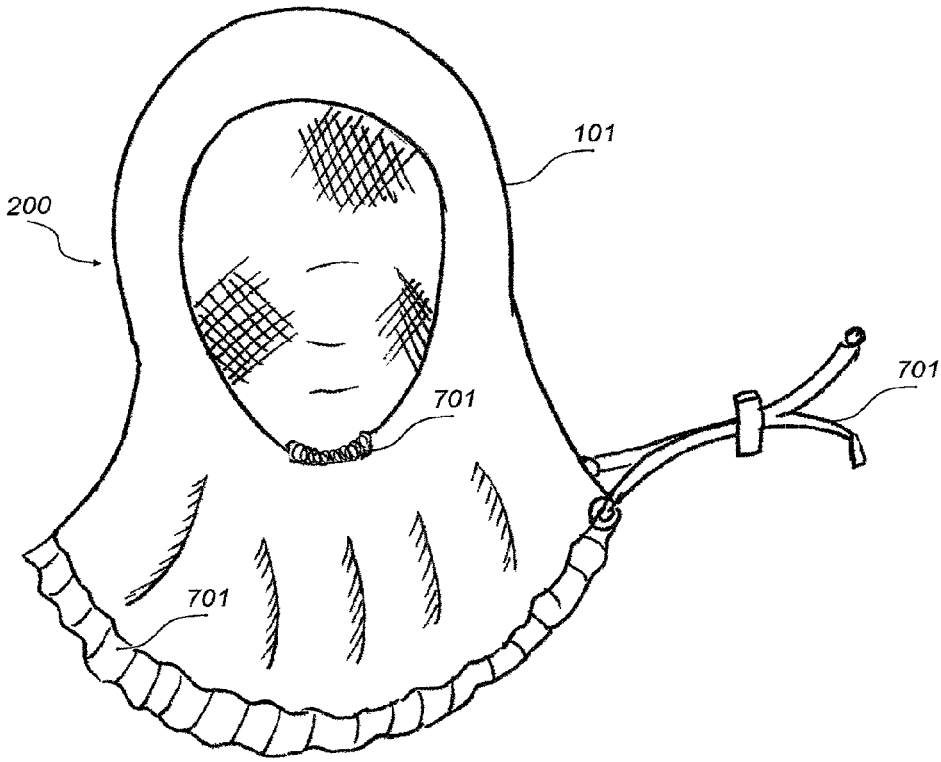

FIG. 7H illustrates the use of two connectors 701; one stretch material connector allocated at the neck for comfort and another one around upper part of the wearer body to loosen or tighten as needed for better fit.

Another Mode for Invention

Figure 8A:
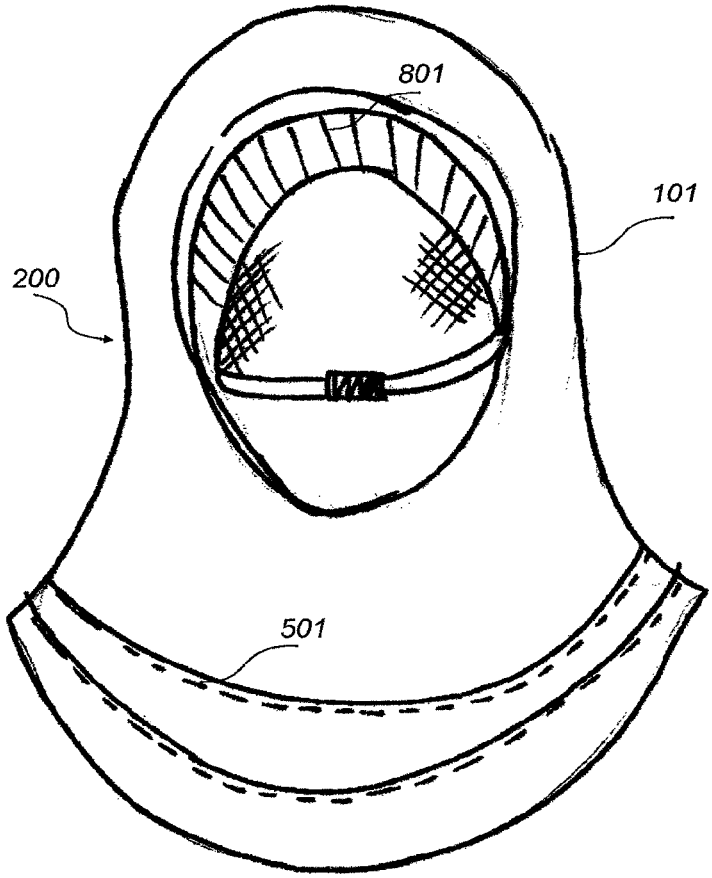
FIG. 8A shows the front plan view of a ready-to-wear headscarf in a formed style 200 where a garment element 101 is stitched in several locations 501 and incorporates a separate headband 801.
Figure 8B:
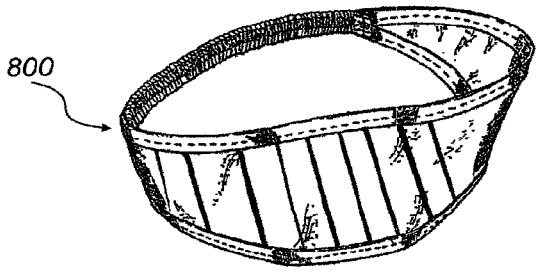
FIG. 8B is a headband selected from a plurality of headbands that can be associated with garment element 101.
Figure 8C:
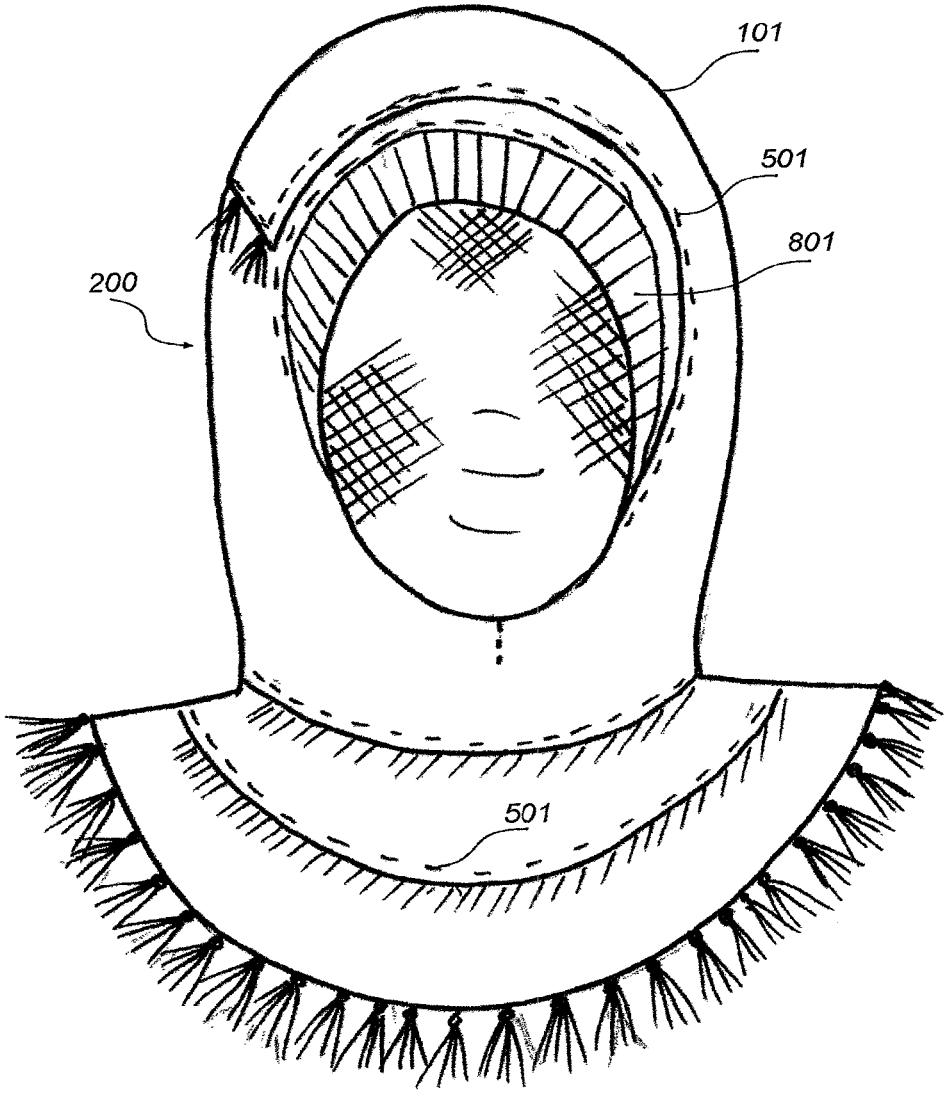
FIG. 8C shows the front plan view of a ready-to-wear headscarf in a formed style 200 where a garment element 101 is stitched in several locations 501 and incorporates an integrated headband 801 sewn to garment element 101.

FIGS. 8A-8C shows the assembly of the formed style headscarf 200 with a headband styling accessory element 801. As defined before this headband element is selected from the group of fabric, leather, stretch material, or any other headband, that is adapted to said garment element with or without a fastener. In FIG. 8A the headband is used as a styling accessory yet it is not integrated with the garment element 101. FIG. 8B shows the headband styling accessory element that can use an elastic rubber band to make it fit on the size of the head of the wearer. Such headband is used as a styling accessory that may be interchanged with others to give stylish appearance as an overall headscarf style, or as a sweat absorbent or as a stabilizer for the headscarf position over the wearers head. In FIG. 8C, a headband uses a sewn stitch fastener to join the garment element 100 to the headband 801 to make the formed style headscarf 200. This same headscarf can use another fastener instead.

Another Mode for Invention

Figure 9A:
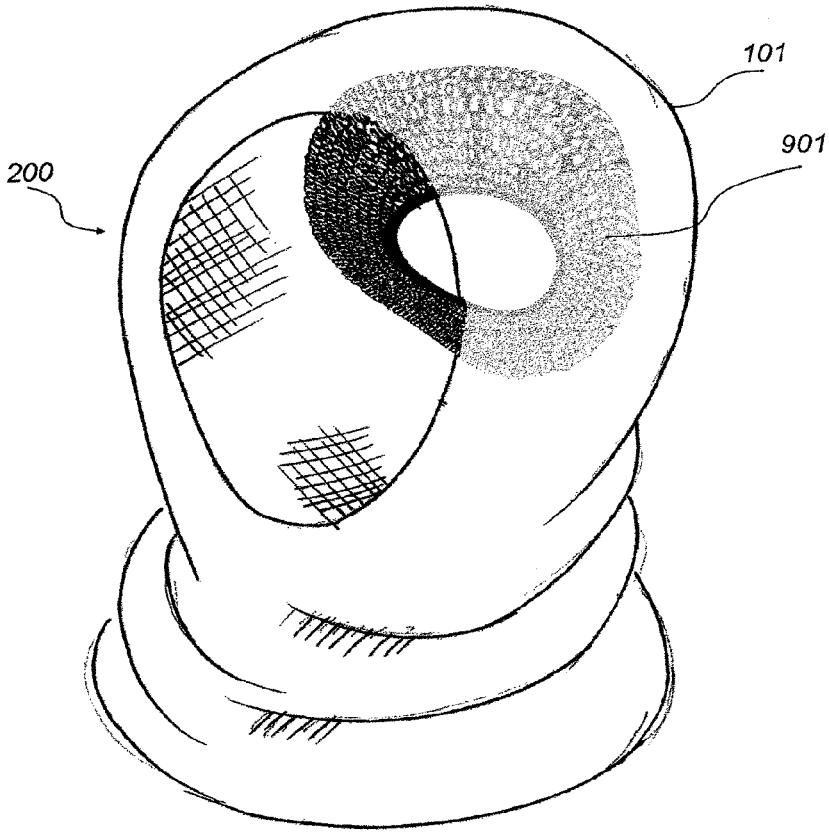
FIG. 9A shows perspective view of a ready-to-wear headscarf in a formed style 200 where a garment element 101 incorporates an integrated hair bun 901 sewn to garment element 101.
Figure 9B:
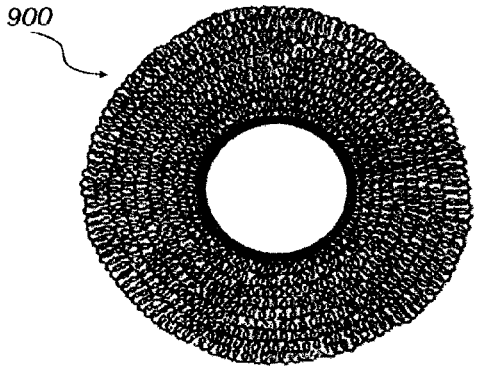
FIGS. 9B-9C is a hair bun selected from a plurality of shaper accessories that can be associated with garment element 101.
Figure 9C:
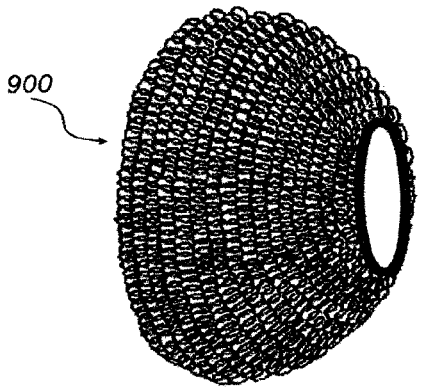

FIG. 9 shows the formed style headscarf element 200 illustrated with one of the selected shaper accessories specifically the hair bun illustrated as element 900 that can be adapted to the ready to wear headscarf element 101 by use of stitches or fasteners to provide a puffy appearance at any side of the wearer's head. The hair bun accessory and any other shaper accessory will be used in a similar way to its use in hair styling.

Another Mode for Invention

Figure 10:
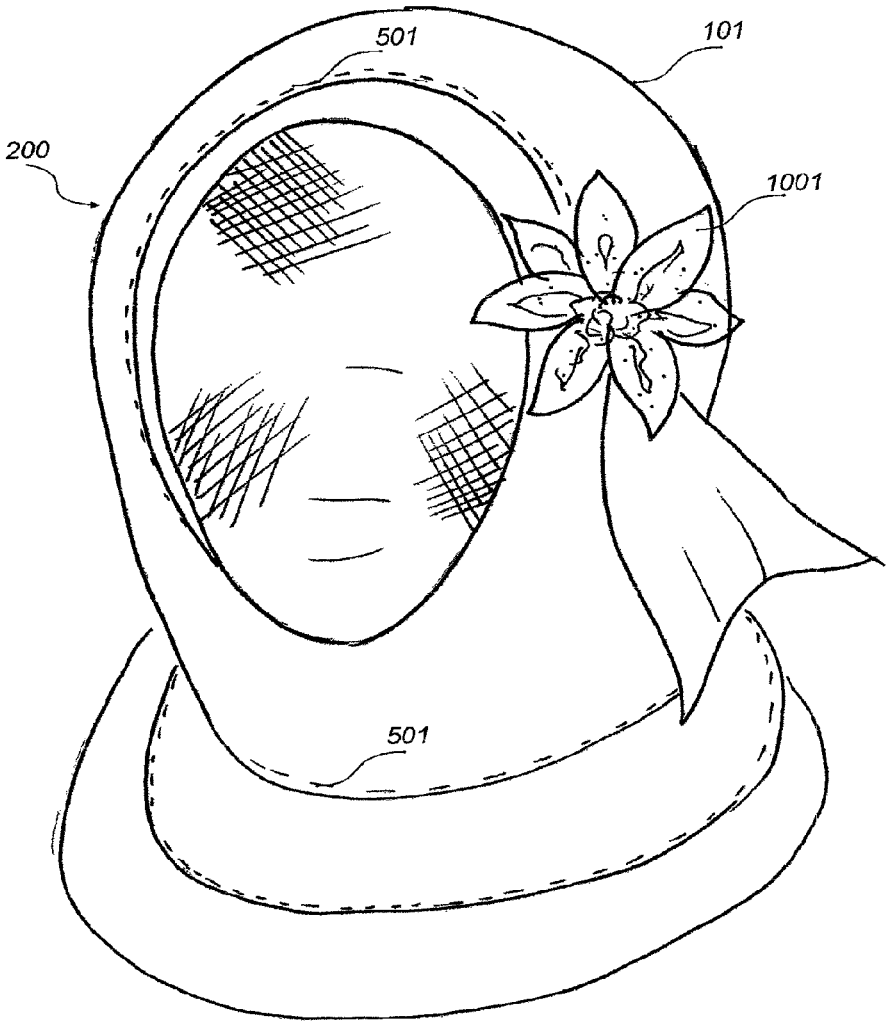
FIG. 10 shows perspective view of a ready-to-wear headscarf in a formed style 200 where a garment element 101 incorporates an integrated fabric element 1001 sewn to garment element 101 and selected from a plurality of interchangeable decorative and ornamental accessories.

FIG. 10 shows the formed element style headscarf element 200 illustrated with an adapted Ornamental and decorative accessory specifically a flower accessory element 1001 that is one of selected ornamental and decorative accessories that include a plurality of objects such as fabric flowers and butterflies made from a plurality of materials such as fabric or metal and can be placed over the surface of the headscarf at any of plurality of locations such as right or left side with respect to the head of a wearer.

INDUSTRIAL APPLICABILITY

The present invention provides a new ready-to-wear headscarf which may be easily and efficiently manufactured and marketed. It is therefore an object of the present invention to provide a new ready-to-wear headscarf which is susceptible of a low cost of manufacture with regard to both materials and labor, and which accordingly is then susceptible of low prices of sale to the consuming public, thereby making such ready-to-wear headscarf economically available to the buying public.

The invention claimed is:

1. A ready-to-wear headscarf consisting of:

a garment element made out of a piece of fabric material, the garment element comprising:

a head portion that covers a user's head, the head portion having a first side, a second side, a top section, a front side and a back side, the head portion containing a face opening at the front side, a neck portion encircling a user's neck, a neck opening located at the bottom of the neck portion, the neck opening is larger in size than the face opening;

a series of stitched seams comprising a front seam, a back seam, and a central seam, the front seam extending along the front side of the head portion from a first end at a bottom of the face opening and intersecting a periphery of the face opening, continuing upwardly along the first side to the top section of the head portion and then downwardly to an upper region of the second side of the head portion, the front seam is offset from the face opening periphery as it extends from the first side to the top section along to the second side, the central seam extends from the front seam at the second side across the upper region of the head portion to the back side of the head portion, the back seam extends from the central seam diagonally from the back side at the top section to a lower portion of the back side adjacent to the neck portion; and the series of stitched seams form the garment element from a planar layer of fabric to the headscarf with overlapping fabric regions adjacent the series of stitched seams.

2. The headscarf according to claim 1, wherein said piece of fabric material is comprised of one panel or a plurality of panels sewn together to form the garment element.

3. The headscarf according to claim 1, wherein the garment element is an ordinary scarf.

4. The headscarf according to claim 1, wherein the garment element is a custom cut scarf.

5. The headscarf according to claim 1 wherein a styling accessory element is attached to the garment element.

* * * * *